United States Patent [19]

Smith

[11] Patent Number: 4,674,015

[45] Date of Patent: Jun. 16, 1987

[54] FLUORESCENT LIGHT FIXTURE WITH REMOVABLE BALLAST

[76] Inventor: Daniel R. Smith, 2051 Maple St., Des Moines, Iowa 50317

[21] Appl. No.: 859,995

[22] Filed: May 5, 1986

[51] Int. Cl.[4] ..... F21S 3/00

[52] U.S. Cl. ..... 362/217; 362/260; 174/DIG. 2

[58] Field of Search ..... 362/217, 260, 221; 339/144 R, 145 R, 145 D; 174/DIG. 2

[56] References Cited

U.S. PATENT DOCUMENTS

| | | | |
|---|---|---|---|
| 1,160,619 | 11/1915 | Klein | 200/51.09 |
| 1,694,715 | 11/1928 | McArdle | 339/147 P |
| 2,189,874 | 2/1940 | Ziganke | 339/65 |
| 2,342,570 | 2/1944 | Biller | 362/296 |
| 2,487,468 | 11/1949 | Naysmith | 362/221 |
| 2,505,112 | 4/1950 | Hallman | 339/53 |
| 2,564,273 | 8/1951 | Neuman | 362/221 |
| 2,574,019 | 11/1951 | Crockett | 362/217 |
| 2,597,060 | 5/1952 | Boutelle et al. | 362/221 |
| 2,702,378 | 2/1955 | Talty | 174/DIG. 2 |
| 2,836,805 | 5/1958 | Goldsmith | 336/136 |
| 3,040,170 | 6/1962 | Chwan | 362/221 |
| 3,514,590 | 5/1970 | Shaeffer | 362/382 |

*Primary Examiner*—Samuel Scott
*Assistant Examiner*—Noah Kamen
*Attorney, Agent, or Firm*—Kenneth J. Hovet

[57] ABSTRACT

A ballast removably insertable into an enclosure of a fluorescent light fixture casing. The ballast utilizes electrical contact tabs for engagement with corresponding tabs within the housing.

15 Claims, 10 Drawing Figures

FLUORESCENT LIGHT FIXTURE WITH REMOVABLE BALLAST

BACKGROUND OF THE INVENTION

1. Field of the Invention

The present invention relates to fluorescent light fixtures and, more particularly, to fixtures having a removable ballast.

2. Description of the Prior Art

Replacement of the heavy ballast used in fluorescent light fixtures is a difficult and time consuming task. Usually the entire fixture has to be dismantled and numerous wires disconnected before a ballast can be removed. During replacement, great care is always necessary to insure the correct wires are reattached to the proper leads on the new ballast.

Attempts to overcome the above disadvantages are described in U.S. Pat. Nos. 2,702,378 and 3,040,170. In the U.S. Pat. No. 2,702,378 patent, electrical contact fingers extend from the ballast ends and are retained within corresponding sockets of connector blocks mounted in the fixture housing. Ballast replacement occurs by lifting the old ballast out of the area between the blocks and putting a new one in its place. The ballast includes an integral flat plate which suspends the ballast over the housing opening.

From the above, it would seem that little was gained in the way of economy or convenience. Specially made connector blocks with sockets are required and, in addition to predetermined opposing fingers, each ballast must include a large integral plate across the top. Access to the fixture top is not always easy and side entry requires removal of the connector blocks and their adaptation to the integral plate.

The U.S. Pat. No. 3,040,170 patent discloses an external ballast having terminals insertable into fixture casing sockets. The ballast includes a slotted end flange so that a sheet metal screw may secure the ballast to the fixture.

While the above is an improvement, it is useless for light fixtures mounted flush to the ceiling. Note the ballast simply rests upon the top of the fixture casing and is held against forces by the metal screw and terminal connectors. Also, a problem with both of the above patents is the relative fragility of the outwardly extending electrical fingers. It will be appreciated that ballast is very heavy and the thin male connectors are especially vulnerable to bending or breakage.

SUMMARY OF THE INVENTION

The present invention provides a fluorescent light fixture having a casing with a side opening adapted to receive a ballast. The back wall of the opening and a wall surface of the ballast are provided with corresponding electrical contact tabs. In this way, the ballast can be easily replaced without regard to fixture placement and concern about breakage of electrical contacts is eliminated. Further, the ballast is safely enclosed within the casing and is inherently secure against unwanted movement.

DESCRIPTION OF THE PREFERRED EMBODIMENTS

Figure 1:
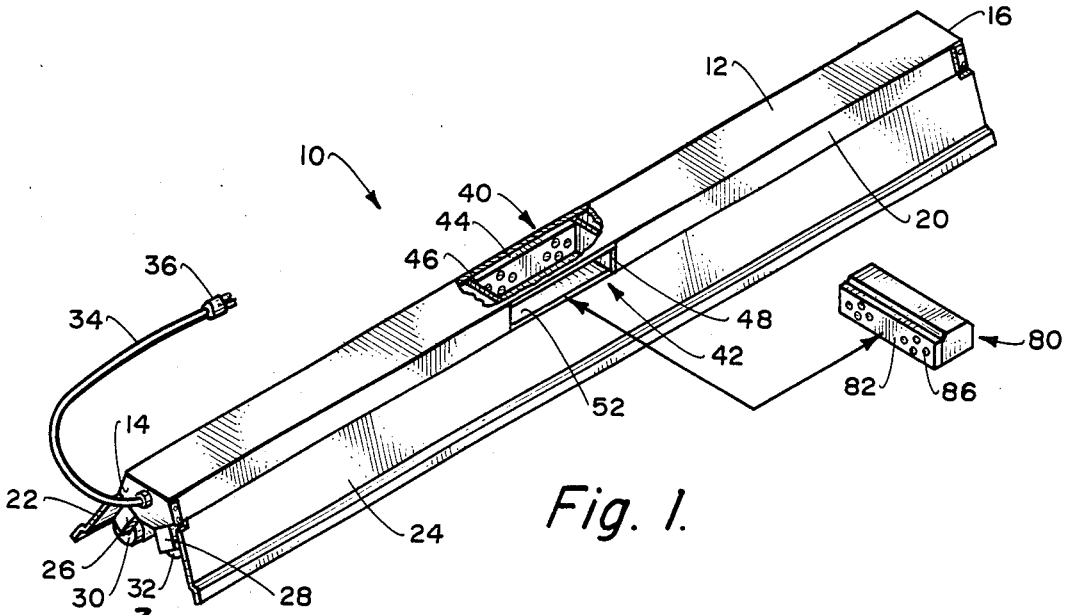
FIG. 1 is a perspective view of a fluorescent light fixture partially broken away to show the ballast enclosure with a ballast exploded therefrom.
Figure 2:
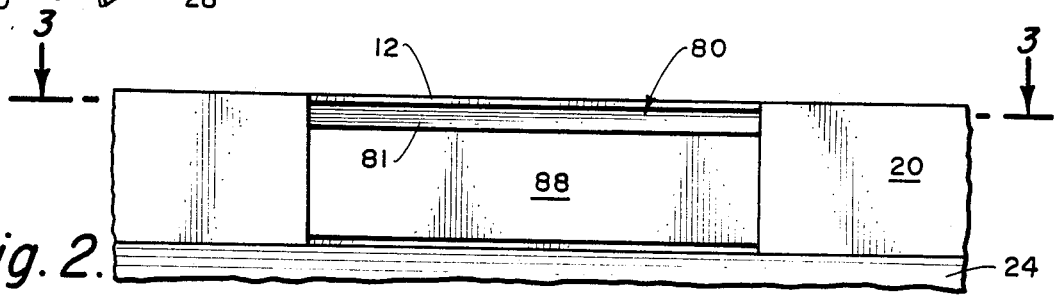
FIG. 2 is an enlarged fragmentary side elevation view of the fixture of FIG. 1 with the ballast in place within the fixture casing.
Figure 3:
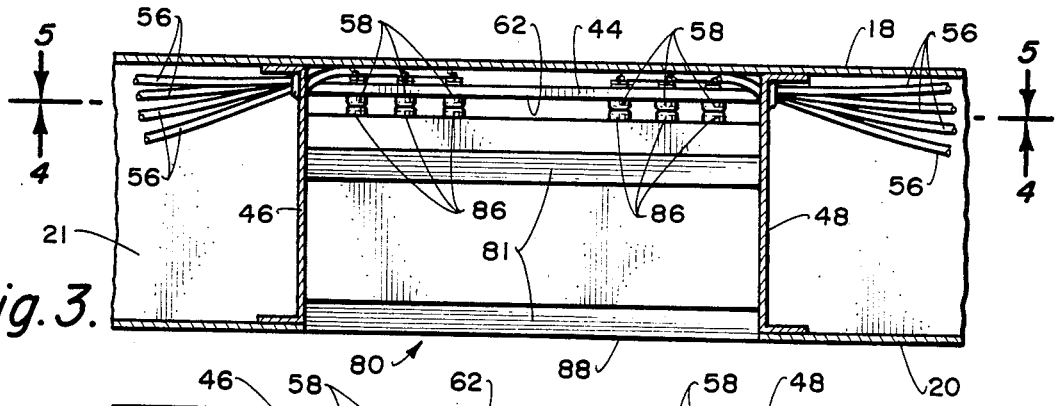
FIG. 3 is a cross-sectional view taken along lines 3—3 of FIG. 2.
Figure 4:
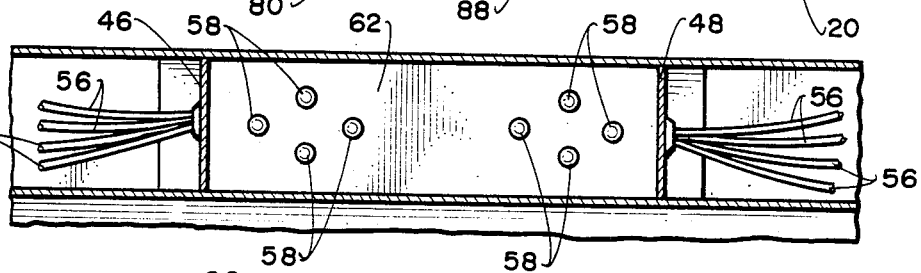
FIG. 4 is cross-sectional view taken along lines 4—4 of FIG. 3.
Figure 5:
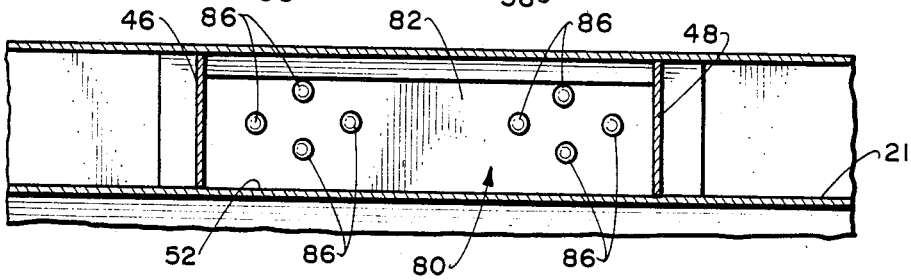
FIG. 5 is a cross-sectional view taken along lines 5—5 of FIG. 3.

With reference now to the drawings, the overall fluorescent light fixture of the invention is shown generally by numeral 10. The fixture is defined by a housing that includes top plate 12 connected to opposing end plates 14, 16, and opposing downwardly extending side plates 18, 20. An inner base plate 21 completes formation of the boxlike housing. Extending from the lower edges of the opposing side plates are optional reflectors 22, 24.

Each of the opposing end plates, 14, 16, are provided with corresponding lamp holders 26, 28, for connection to fluorescent light bulbs 30, 32. The corresponding lamp holders on plate 16 are not shown. Extending from end plate 14 is electrical cord 34 having plug 36 for connection to a power source. The housing includes appropriate wiring from end 34 to the lamp holders, ballast contacts, and associated starter in a manner, not shown, which is known in the art.

Located proximate the midpoint of side plate 20 is ballast enclosure 40. The enclosure extends from front opening 42 in the side plate, to a back wall 44. It includes opposing side walls 46, 48, connecting with upper wall 50 and lower wall 52. Preferably, the enclosure corresponds in size and shape to the ballast 80. In this way, the ballast will be enclosed within the fixture housing in an unobtrusive, effective and safe manner.

As shown, the enclosure 40 is rectangular in shape with overall dimensions slightly greater than the corresponding dimensions of the ballast. The ballast includes upper beveled edges 81 to facilitate its insertion and removal from the enclosure.

Back wall 44 is spaced apart from housing wall 18 to permit electrical conductors, shown collectively as 56, to connect with corresponding electrical contact tabs 58. The tabs extend from the front surface 62 of back wall 44. They are outwardly extending projections constructed of electrically conductive metal such as copper, brass, aluminum, or alloys thereof. The tabs and/or back wall may be spring biased in a manner to be hereinafter described to insure affirmative contact with corresponding tabs 86 on the ballast face 82.

Each tab 58 is mounted on a conductive pin 60 that extends through wall 44 and connects with connector means shown as wire lead 57. The wire leads attach to conductors 56 which connect with the fixture circuit.

The front wall 82 of the ballast is provided with the aforementioned electrical contact tabs 86. They are constructed of the same materials as tabs 58. The tabs extend outwardly from the front wall with each tab oriented on said wall in a manner to be a mirror-image and directly opposite of a corresponding tab 58 on the back wall 44. As such, when the ballast is inserted within the enclosure, each tab 86 will be in physical contact with its corresponding back wall tab 58 so that an electrical circuit through the ballast will be completed. The tabs are constructed of a metallic electrically conductive material and may be rigid or flexible or spring-biased in the same manner as the back wall tabs.

With reference now to FIGS. 6, 7, 9 and 10, alternative tab biasing means are shown. In each instance, the objective is to facilitate, maintain and enhance the physical abutment between corresponding pairs of tabs 58 and 86.

Figure 6:
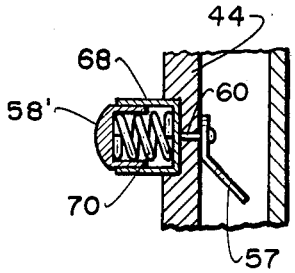
FIG. 6 is an enlarged fragmentary cross-sectional view showing an alternative electrical contact.

FIG. 6 shows, in detail, a slidable tab 58 mounted within a socket 68 which contains a coil spring 70. Conductor pin 60 extends from the socket through the back wall 44 to electrical lead 57. In this way, the tab may reciprocate as needed within the socket and maintain affirmative engagement with a corresponding tab 86 pressed thereagainst.

Figure 7:
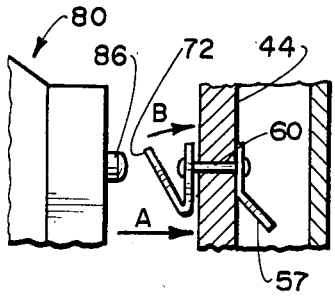
FIG. 7 is an enlarged fragmentary cross-sectional view showing another alternative electrical contact with a corresponding ballast contact spaced-apart therefrom.

FIG. 7 shows another alternative embodiment wherein tab 58 is replaced with a flexible electrically conductive leaf spring member 72 formed somewhat in the shape of a V. The member is connected to the back wall 44 by conductor pin 60 which connects with wire lead 57. As tab 86 impinges upon the end of the spring, as shown by arrow A, it will flex inwardly in the direction of arrow B. In this way, variations in relative depth alignment of the tabs will be accommodated while always assuring a positive contact and electrical connection.

Figure 9:
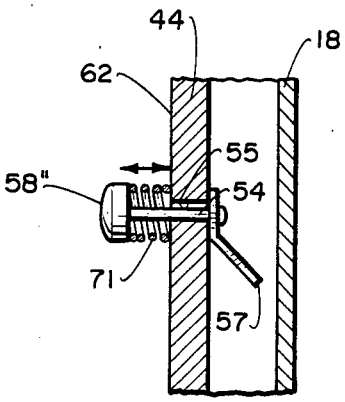
FIG. 9 is an enlarged fragmentary cross-sectional view showing another alternative electrical contact.

FIG. 9 illustrates another alternative tab biasing means wherein tab pin 54 reciprocates within opening 55 of wall 44. The electrically conductive pin includes tab $58^{11}$ at one end and electrical lead 57 at the opposing end. Coil spring 71 encircles the pin between face 62 and the underside of tab $58^{11}$ and biases the tab outwardly. This permits axial movement of the tab and fosters good contact with a corresponding tab 86.

Figure 10:
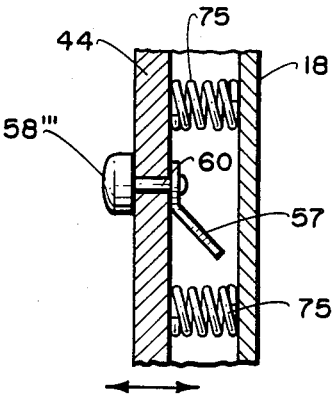
FIG. 10 is an enlarged fragmentary cross-sectional view showing an additional alternative electrical contact arrangement.

In FIG. 10, the entire wall 44 is free floating and mounted for reciprocation on support springs 75. The springs are spaced about in a predetermined manner to connect and vertically support wall 44 to fixture side plate 18. In this embodiment, the pin 60 and tab $58^{111}$ are secured to wall 44 and move with the wall as tabs 86 are pushed thereagainst. This variation has the advantage of requiring fewer parts and less assembly time.

The outer panel 88 of the ballast is preferably coextensive with housing side plate 20 when the ballast is completely inserted within the enclosure. This results in a more aesthetically pleasing appearance and helps to maintain proper alignment and contact between the opposing tabs. In this regard, it may be desirable to include a knob or handle, such as handle 76, or other manually grasping means to facilitate the insertion and removal of the ballast.

Figure 8:
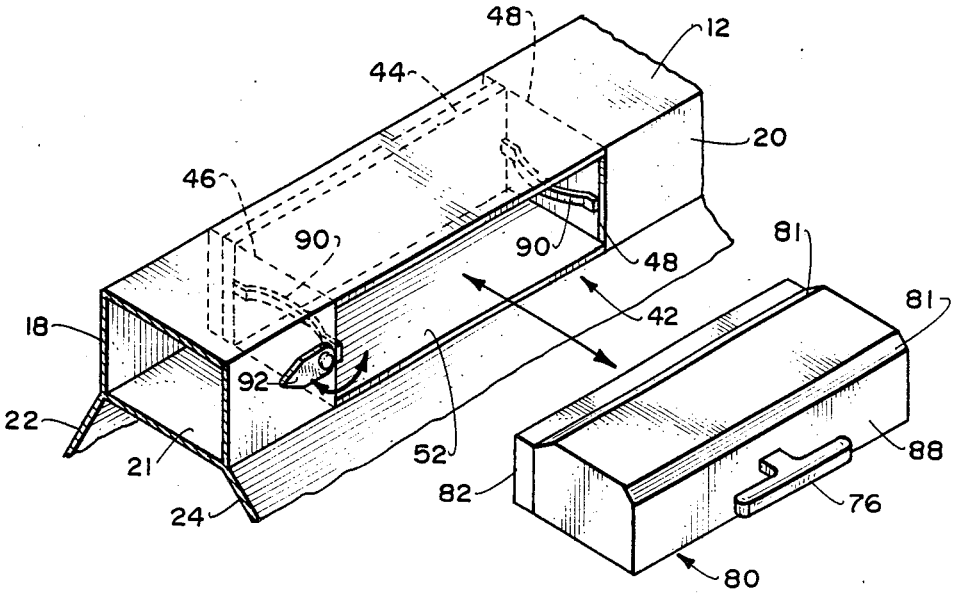
FIG. 8 is a fragmentary perspective view depicting alternative ballast retention means and handle means.

In some cases it may be desirable to include retention means for insuring against the displacement of the ballast and dislodgement of the tabs from each other. In such instances, any of the means shown in FIG. 8 may be utilized. For example, opposing flexible wall straps 90 may be secured to the opposing side walls of the enclosure to frictionally engage the opposing walls of the ballast and help maintain the ballast within the enclosure. Alternately, a rotating catch shown as rotating member 92 may be swung in place against wall 88 after the ballast is inserted in the enclosure to hold it tightly within the enclosure. Other means known in the art, such as a clip, strap or even a hinged door, closing over the opening 42, may be utilized.

It will be appreciated that the number of tabs and ballast size will vary in accordance with the number of lampholders, bulbs and wattage being utilized with the fixture. The number of electrical leads extending in and out of the back wall of the enclosure will also vary accordingly. A rhombic-shaped arrangement of tabs is shown in the drawings. However, other arrangements and numbers of tabs may be used or required as above suggested. To guard against inadvertent upside-down insertion of the ballast by an inexperienced workman, the cross-sectional shape of the ballast and opening 42 may resemble an uneven triangle, trapezoid or irregular polygon. In this manner, the ballast may be inserted in only one way. Similarly, the above-described mirror image arrangement of opposing tabs may define an outline that is asymmetrical so that some of the tabs will not meet and complete the circuit if the ballast is inserted upside-down.

As above described, it will be appreciated that applicant has designed a unique system for changing ballast expeditiously, safely and quickly without any disturbance to the overall light fixture per se or any of the electrical circuitry connected therewith. This of course promotes fixture long life and avoids disturbance of the fragile bulbs and electrical components. The invention has particular application with ballast replacement on the large numbers of fixtures commonly utilized continuously day after day in large office buildings.

Further, applicant's device permits a design that allows for fool-proof ballast connection. Also, the geometry of a ballast for a particular fixture may be designed to be specific for that fixture only. Thus, improper ballast choice will be eliminated.

Still further, the prongs, connector blocks, flanges and unsightly ballast attachments of the prior art are eliminated. A clean streamlined fixture appearance is obtainable while also providing for a wholly unobstructed ballast access.

While the invention has been above described with respect to preferred embodiments, it will be apparent to those skilled in the art that other modifications may be made without departing from the scope and spirit of the invention. As such, it will be understood that the invention is not to be limited by the above specific embodiments, but only by the scope of the appended claims.

I claim:

1. In a fluorescent light fixture comprising:

a housing having a top plate for mounting on a structural surface and side plates extending downwardly from side edges of said top plate, wherein fluorescent lights are located beneath said top plate and proximate said side plates;

an opening in one of said side plates by which a ballast is replaceably inserted into an enclosure, said enclosure including a wall having a plurality of electrical contact tabs;

said ballast having a wall with a plurality of electrical contact tabs corresponding to each of said enclosure wall tabs for forming an electrical contact therewith and completing an electrical circuit through the ballast.

2. The fixture of claim 1 wherein said enclosure wall comprises a back wall thereof and said ballast wall comprises a front wall.

3. The fixture of claim 1 wherein said tabs are metallic projections extending from said wall surfaces.

4. The fixture of claim 2 wherein the tabs on said back wall have a resilient outward bias to insure engagement with corresponding opposing tabs on said ballast front wall.

5. The fixture of claim 1 wherein said enclosure surrounds said ballast except for the outer wall thereof.

6. The fixture of claim 5 wherein the inner walls of said enclosure frictionally engage portions of said ballast exterior to retain it therein.

7. The fixture of claim 5 wherein said enclosure includes retention means for retaining said ballast therein.

8. The fixture of claim 7 wherein said retention means is a member selected from the group consisting of pivoted catch member, strap, hinged door, slide member, clip and hook.

9. The fixture of claim 2 wherein the tabs on said ballast front wall have a resilient outward bias.

10. The fixture of claim 2 wherein said enclosure wall tabs are orthogonally yieldable relative to said back wall and include means for exerting an outward bias therefrom.

11. The fixture of claim 2 further including means for yieldably mounting said back wall.

12. The fixture of claim 4 wherein the tabs on said back wall comprise a V-shaped leaf spring member.

13. The fixture of claim 10 wherein each tab includes a pin extending therefrom through said back wall to an electrical connector means.

14. The fixture of claim 13 wherein the pin extend through an opening in said back wall.

15. The fixture of claim 14 wherein said outward bias means comprises a coil spring encircling said pin between said tab and back wall.

* * * * *